US006018823A

United States Patent [19]

Ortmeier

[11] Patent Number: 6,018,823

[45] Date of Patent: Feb. 1, 2000

[54] WOMEN'S UNDERGARMENT WITH REAR POUCH

[76] Inventor: Suzan M. Ortmeier, 13351 D. Riverside Dr. #301, Sherman Oaks, Calif. 91423

[21] Appl. No.: 09/310,837

[22] Filed: May 12, 1999

[51] Int. Cl.[7] ..... A41B 9/02

[52] U.S. Cl. ..... 2/406; 2/67; 450/150

[58] Field of Search ..... 2/400–408, 228, 2/238, 67, 69; 450/156, 150

[56] References Cited

U.S. PATENT DOCUMENTS 2,544,840 3/1951 Kowatsch ..... 2/67
2,854,669 10/1958 Cohen ..... 2/67
5,093,935 3/1992 Countee, Jr. ..... 2/400
5,172,430 12/1992 Lerma-Solis ..... 2/400

*Primary Examiner*—Gloria Hale
*Attorney, Agent, or Firm*—Goldstein & Canino

[57] ABSTRACT

A women's undergarment with rear pouch including a body portion adapted for being worn about a trunk of a wearer below a waist thereof. The body portion includes a front portion and a back portion fabricated of a four way stretch fabric. The back portion includes an interior layer and an exterior layer. A four way stretch fabric band is provided that is adapted for being worn about a waist area of a wearer. The four way stretch fabric band is secured to the body portion. The back portion of the body portion has a pocket formed thereon. The pocket receives a microphone pack therein.

2 Claims, 1 Drawing Sheet

WOMEN'S UNDERGARMENT WITH REAR POUCH

BACKGROUND OF THE INVENTION

The present invention relates to a women's undergarment with rear pouch and more particularly pertains to allowing a woman to hold a microphone pack snugly against her body.

Women's undergarments of the type worn about the lower trunk of the body may take a variety of conventional forms ranging from a pair of panties or the like. Inasmuch as all such garments are designed to be worn beneath outer garments and clothing, such undergarments have never been designed nor intended to carry personal items of the wearer. Although recent advancements have been made in this art for the security of routinely-carried personal items and valuables such as currency, credit cards, keys, identification, etc. in secure storage areas incorporated within the undergarment, such advancements do not enable a woman to specifically carry a microphone pack on her person.

The present invention seeks to provide an undergarment that is adapted to specifically provide a storage space for holding a microphone pack against the backside of the wearer.

The use of undergarments with pockets is known in the prior art. More specifically, undergarments with pockets heretofore devised and utilized for the purpose of storing small objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,067,178 to Katchka discloses an undergarment such as a pair of women's panties with an integral pocket made of an elastic material. U.S. Pat. No. 5,093,935 to Countee, Jr. discloses an undergarment with a pocket for storing small objects such as prophylactics. U.S. Pat. No. 4,852,188 to Marsh discloses a panty with a security pocket for storing such objects as money and identification.

While these devices fulfill their respective, particular objective and requirements, the aforementioned patents do not describe a women's undergarment with rear pouch for allowing a woman to hold a microphone pack snugly against her body.

In this respect, the women's undergarment with rear pouch according to the present invention substantially departs from the conventional concepts and designs of the prior art, and in doing so provides an apparatus primarily developed for the purpose of allowing a woman to hold a microphone pack snugly against her body.

Therefore, it can be appreciated that there exists a continuing need for new and improved women's undergarment with rear pouch which can be used for allowing a woman to hold a microphone pack snugly against her body. In this regard, the present invention substantially fulfills this need.

SUMMARY OF THE INVENTION

In the view of the foregoing disadvantages inherent in the known types of undergarments with pockets now present in the prior art, the present invention provides an improved women's undergarment with rear pouch. As such, the general purpose of the present invention, which will be described subsequently in greater detail, is to provide a new and improved women's undergarment with rear pouch and method which has all the advantages of the prior art and none of the disadvantages.

To attain this, the present invention essentially comprises a body portion adapted for being worn about a trunk of a wearer below a waist thereof. The body portion includes a front portion and a back portion each made of a four way stretch fabric. The back portion includes an interior layer and an exterior layer. A four way stretch fabric band is provided that is adapted for being worn about the waist or hips of a wearer. The four way stretch fabric band is secured to the body portion whereby the entire front portion and back portion's interior layer are fully secured to the four way stretch fabric band and whereby the exterior layer of the back portion is not entirely secured to the four way stretch fabric band thereby defining an opening between the exterior layer and the interior layer of the back portion. A resulting pocket receives a microphone pack therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved women's undergarment with rear pouch which has all the advantages of the prior art undergarments with pockets and none of the disadvantages.

It is another object of the present invention to provide a new and improved women's undergarment with rear pouch which may be easily and efficiently manufactured and marketed.

It is a further object of the present invention to provide a new and improved women's undergarment with rear pouch which is of durable and reliable construction.

An even further object of the present invention is to provide a new and improved women's undergarment with rear pouch which is susceptible of a low cost of manufacture with regard to both materials and labor, and which accordingly is then susceptible of low prices of sale to the consuming public, thereby making such a women's undergarment with rear pouch economically available to the buying public.

Even still another object of the present invention is to provide a new and improved women's undergarment with rear pouch for allowing a woman to hold a microphone pack snugly against her body.

Lastly, it is an object of the present invention to provide a new and improved women's undergarment with rear pouch including a body portion adapted for being worn about a trunk of a wearer below a waist thereof. The body portion includes a front portion and a back portion made of a four way stretch fabric. The back portion includes an interior layer and an exterior layer. A four way stretch fabric band is provided that is adapted for being worn about a waist or hip area of a wearer. The four way stretch fabric band is secured to the body portion. The back portion of the body portion has a pocket formed thereon. The pocket receives a microphone pack therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
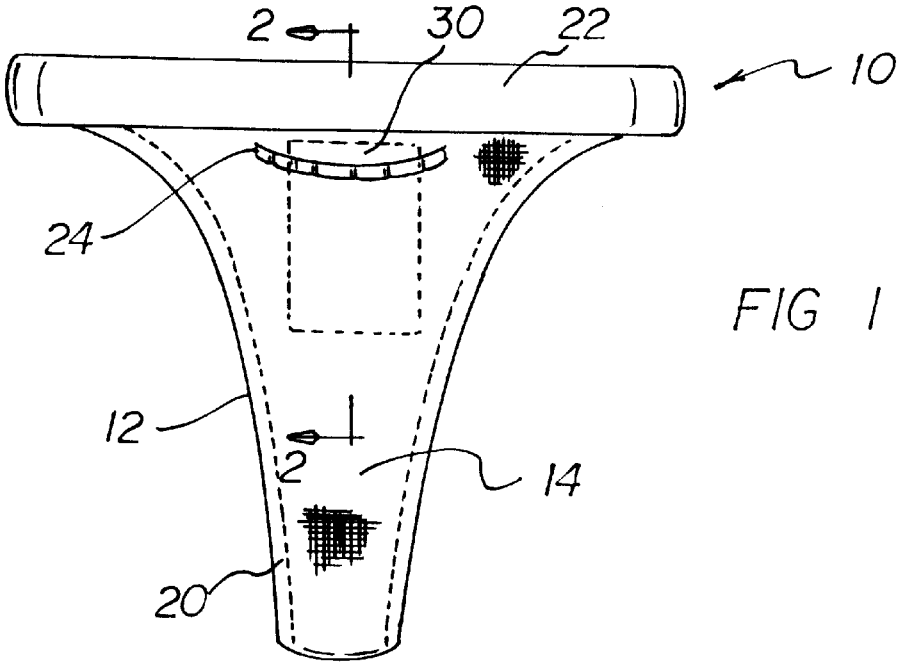
FIG. 1 is a rear elevation view of the preferred embodiment of the women's undergarment with rear pouch constructed in accordance with the principles of the present invention.
Figure 2:
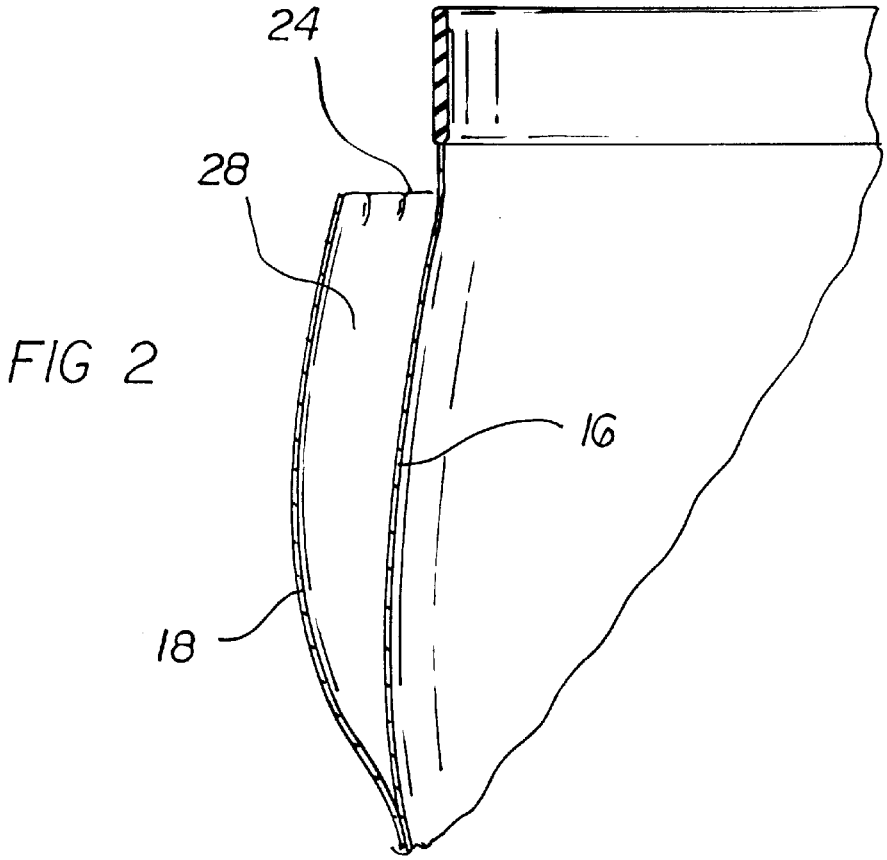
FIG. 2 is a cross-sectional view of the present invention as taken along line 2—2 of FIG. 1.

With reference now to the drawings, and in particular, to FIGS. 1 through 2 thereof, the preferred embodiment of the new and improved women's undergarment with rear pouch embodying the principles and concepts of the present invention and generally designated by the reference number 10 will be described.

Specifically, it will be noted in the various Figures that the device relates to a women's undergarment with rear pouch for allowing a woman to hold a microphone pack snugly against her body. In its broadest context, the device consists of a body portion and an four way stretch fabric band. Such components are individually configured and correlated with respect to each other so as to attain the desired objective.

The body portion 12 is adapted for being worn about a trunk of a wearer below a waist thereof. The body portion 12 includes a front portion and a back portion 14. The back portion 14 includes an interior layer 16 and an exterior layer 18. The body portion 12 would also include soft elastic edges 20 around leg openings thereof.

The four way stretch fabric band 22 is adapted for being worn about a waist or hip area of a wearer. The four way stretch fabric band 22 is secured to the body portion 12 whereby the front portion and the interior layer 16 of the back portion are fully secured to the four way stretch fabric band 22 and whereby the exterior layer 18 of the back portion 14 is not entirely secured to the four way stretch fabric band 22 thereby defining an opening 24 between the exterior layer 18 and the interior layer 16 of the back portion 14. The opening 24 between the interior and exterior layers forms a pocket 28. Note FIG. 2. The pocket 28 receives a microphone pack 30 therein. The opening 24 is also provided with a soft elastic edge that will serve to further secure the microphone pack when disposed within the pocket 28. Note FIG. 1.

In use, when the body portion 12 is worn about the trunk of the wearer, the pocket 28 will then receive the microphone pack 30 whereby it will remain snugly against the back of the wearer. This will reduce the possibility of the microphone pack 30 falling out of the pocket 28.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A women's undergarment with rear pouch for allowing a woman to hold a microphone pack snugly against her body comprising, in combination:

a body portion adapted for being worn about a trunk of a wearer below a waist thereof, the body portion including a front portion and a back portion both fabricated of a four way stretch fabric, the front portion being comprised of a single layer, the back portion including an interior layer and an exterior layer;

a four way stretch fabric band adapted for being worn about a waist area of a wearer, the four way stretch fabric band being secured to the body portion whereby the front portion and the interior layer of the back portion are fully secured to the four way stretch fabric band and the exterior layer of the back portion is not entirely secured to the four way stretch fabric band thereby defining an opening between the exterior layer and the interior layer of the back portion to form a pocket, the pocket receiving a microphone pack therein.

2. A women's undergarment with rear pouch for allowing a woman to hold a microphone pack snugly against her body comprising, in combination:

a body portion adapted for being worn about a trunk of a wearer below a waist thereof, the body portion including a front portion and a back portion, the back portion including an interior layer and an exterior layer;

a four way stretch fabric band adapted for being worn about a waist area of a wearer, the four way stretch fabric band being secured to the body portion, a pocket formed on the back portion of the body portion, the pocket receiving a microphone pack therein.

* * * * *